US010123590B2

(12) United States Patent
Kolasa et al.

(10) Patent No.: US 10,123,590 B2
(45) Date of Patent: Nov. 13, 2018

(54) SYSTEM AND ASSEMBLY FOR SECURING A BUCKLE HOUSING TO A COMPONENT

(71) Applicant: ILLINOIS TOOL WORKS INC., Glenview, IL (US)

(72) Inventors: Scott D. Kolasa, Mount Prospect, IL (US); John S. Pontaoe, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 279 days.

(21) Appl. No.: 14/902,040

(22) PCT Filed: May 5, 2014

(86) PCT No.: PCT/US2014/036824

§ 371 (c)(1),
(2) Date: Dec. 30, 2015

(87) PCT Pub. No.: WO2015/005969

PCT Pub. Date: Jan. 15, 2015

(65) Prior Publication Data

US 2016/0366989 A1 Dec. 22, 2016

Related U.S. Application Data

(60) Provisional application No. 61/844,637, filed on Jul. 10, 2013.

(51) Int. Cl.

| | |
|---|---|
| ***A44B 11/25*** | (2006.01) |
| ***A44B 11/00*** | (2006.01) |
| ***A44B 11/26*** | (2006.01) |

(52) U.S. Cl.

CPC ..... *A44B 11/258* (2013.01); *A44B 11/006* (2013.01); *A44B 11/26* (2013.01)

(58) Field of Classification Search
CPC combination set(s) only.
See application file for complete search history.

(56) References Cited

U.S. PATENT DOCUMENTS 4,800,629 A * 1/1989 Ikeda ..... A44B 11/005 24/170
4,825,515 A * 5/1989 Wolterstorff, Jr. ... A44B 11/263 24/196

(Continued)

FOREIGN PATENT DOCUMENTS

EP 1325690 A2 7/2003
EP 1922946 A2 5/2008

(Continued)

OTHER PUBLICATIONS

ISR and WO for PCT/US2014/036824 dated Aug. 1, 2014.

*Primary Examiner* — Jason W San
(74) *Attorney, Agent, or Firm* — Joseph M. Butscher; The Small Patent Law Group, LLC

(57) ABSTRACT

A buckle assembly is configured to securely attach to a component and may include a buckle housing and a securing member. The buckle housing may include a first connecting protuberance or first protuberance-retaining structure, and a second connecting protuberance or the second protuberance-retaining structure. The securing member may include the other of the first connecting protuberance or the first protuberance-retaining structure, and the other of the second connecting protuberance or the second protuberance-retaining structure. The first protuberance-retaining structure is configured to slidably receive the first connecting protuberance in a sliding direction. The second protuberance-retaining structure is configured to securely retain the second connecting protuberance so that the buckle housing is secured with respect to the securing member.

20 Claims, 5 Drawing Sheets

(56) References Cited

U.S. PATENT DOCUMENTS 5,170,539 A * 12/1992 Lundstedt ..... A44B 11/006 24/194
5,465,472 A 11/1995 Matoba
5,774,956 A * 7/1998 French ..... A44B 11/263 24/616
6,263,548 B1 * 7/2001 Ikeda ..... A44B 11/266 24/616
6,311,374 B1 * 11/2001 Anscher ..... A44B 11/263 24/625
6,510,592 B1 * 1/2003 Hamilton ..... A44B 11/06 24/170
6,622,355 B2 * 9/2003 Buscart ..... A44B 11/006 24/271
6,668,428 B2 12/2003 Moeller
7,089,633 B2 * 8/2006 Liu ..... A44B 11/266 24/615
7,296,327 B2 11/2007 Anderson et al.
7,302,742 B2 12/2007 Pontaoe
7,331,088 B2 2/2008 Pontaoe
7,954,212 B2 * 6/2011 Funo ..... A44B 11/006 24/625
8,112,850 B2 * 2/2012 Uehara ..... A44B 11/266 24/197
9,015,912 B2 * 4/2015 Nanbu ..... A44B 11/266 24/615
9,032,767 B2 * 5/2015 Takahashi ..... A44B 11/2546 24/614
9,232,833 B2 * 1/2016 Paik ..... A44B 11/266
9,676,297 B2 * 6/2017 Peniche ..... B60N 2/0725
9,750,310 B2 * 9/2017 Kolasa ..... A44B 11/26
2003/0121130 A1 7/2003 Buscart et al.
2007/0089280 A1 4/2007 Pontaoe
2007/0193004 A1 8/2007 Chou
2008/0115346 A1 5/2008 Funo et al.
2008/0222860 A1 9/2008 Pontaoe
2010/0306976 A1 * 12/2010 Kaneko ..... A44B 11/266 24/700
2012/0017407 A1 * 1/2012 Uehara ..... A44B 11/266 24/700
2014/0096348 A1 4/2014 Anderson et al.
2015/0135494 A1 * 5/2015 Kataguchi ..... A44B 11/266 24/697.1
2015/0143675 A1 * 5/2015 Nanbu ..... A44B 11/266 24/697.1
2015/0237972 A1 * 8/2015 Kolasa ..... A44B 11/26 24/197
2015/0351500 A1 * 12/2015 Kolasa ..... A44B 11/266 24/615

FOREIGN PATENT DOCUMENTS

JP 2010057659 A 3/2010
KR 200268089 Y1 3/2002
WO 2012162615 A2 11/2012

* cited by examiner

SYSTEM AND ASSEMBLY FOR SECURING A BUCKLE HOUSING TO A COMPONENT

RELATED APPLICATIONS

This application is a National Phase of PCT/US2014/036824 filed May 5, 2014 and relates to and claims priority benefits from U.S. Provisional Patent Application No. 61/844,637 filed Jul. 10, 2013, which is hereby incorporated by reference in its entirety.

FIELD OF EMBODIMENTS OF THE DISCLOSURE

Embodiments of the present disclosure generally relate to buckle assemblies, and, more particularly, to systems and methods for securing a buckle housing to a component.

BACKGROUND

Buckles are used in various applications to selectively connect and disconnect components together. For example, a belt used with respect to pants includes a buckle having first and second connection members, such as a male connection member and a reciprocal female connection member. Also, various backpacks, bags, articles or clothing, and the like include buckles.

A conventional side-release buckle assembly, for example, includes a male connection member that is configured to mate with a female connection member, such as shown and described in U.S. Pat. No. 5,465,472, entitled "Buckle." Each connection member is configured to retain a strap, such as a seatbelt or backpack strap, for example. The male connection member includes integral buttons that may be engaged to release the male connection member from the female connection member, thereby disconnecting the buckle assembly.

Typically, one or both of the connection members is secured to a component, such as a strap, web, or the like. For example, a male connection member may be secured to one end of a belt, while a reciprocal female connection member may be secured to an opposite end of the belt.

One type of buckle assembly includes a plate that is slid in multiple directions with respect to a component in relation to a counterpart structure of the buckle assembly in order to secure the buckle assembly to the component. However, the process of sliding the plate in multiple directions may be difficult and counterintuitive.

Another type of buckle assembly includes a plate that has obtrusive edges that are susceptible to catching on material. Another type of buckle assembly provides a ratchet-type securing structure that may also prove difficult to mount to a structure, and may be not be aesthetically desirable. Still another type of buckle assembly includes a plate and counterpart structure that are integrally formed and molded as a single piece and may be used with a component having a particular defined size and shape.

In general, the process of manufacturing known buckle assemblies and securing them to components may be time and labor-intensive.

SUMMARY OF EMBODIMENTS OF THE DISCLOSURE

Certain embodiments of the present disclosure provide a buckle assembly configured to securely attach to a component. The buckle assembly may include a buckle housing, such as one or both of a female connection member or a male connection member, and a securing member. The buckle housing may include a first connecting protuberance or first protuberance-retaining structure, and a second connecting protuberance or a second protuberance-retaining structure. The securing member may include the other of the first connecting protuberance or the first protuberance-retaining structure, and the other of the second connecting protuberance or the second protuberance-retaining structure. The first protuberance-retaining structure may be configured to slidably receive the first connecting protuberance in a sliding direction. The second protuberance-retaining structure may be configured to securely retain the second connecting protuberance so that the buckle housing is secured with respect to the securing member. In at least one embodiment, the second protuberance-retaining structure is configured to snapably retain the second connecting protuberance. At least a portion of the component may be configured to be compressively sandwiched between the buckle housing and the securing member.

The first connecting protuberance may include an outwardly-directed flange connected to an extension beam. The second connecting protuberance may include outwardly-directed flanges extending from opposite sides of an extension beam. The first protuberance-retaining structure may include an outer retaining wall defining a central passage. A ledge may inwardly extend into the central passage from an interior surface of the outer retaining wall.

The second protuberance-retaining structure may include lateral arms defining an open mouth. Ledges may extend inwardly from interior surfaces of the lateral arms.

At least one securing force between the second protuberance-retaining structure and the second connecting protuberance is increased when an extraneous load is exerted into the component, such as a fabric, onto which the buckle housing and the securing member are secured. For example, as a force, such as an extraneous load, is applied to the component, the securing force between the protuberance-retaining structure and the connecting protuberance increases.

Certain embodiments of the present disclosure provide a buckle system that may include a component defining first and second openings, a buckle housing including a first connecting protuberance or a first protuberance-retaining structure, and a second connecting protuberance or a second protuberance-retaining structure, and a securing member including the other of the first connecting protuberance or the first protuberance-retaining structure, and the other of the second connecting protuberance or the second protuberance-retaining structure. The first connecting protuberance extends through the first opening and the second connecting protuberance extends through the second opening. The first protuberance-retaining structure is configured to slidably receive the first connecting protuberance in a sliding direction. The second protuberance-retaining structure is configured to securely retain the second connecting protuberance so that the buckle housing is securely fixed with respect to the securing member.

Certain embodiments of the present disclosure provide a buckle assembly configured to securely attach to a component. The buckle assembly may include a buckle housing and a securing member. The buckle housing may include first and second connecting protuberances or first and second protuberance-retaining structures symmetrically positioned about a longitudinal axis of a main body, and a third connecting protuberance or a third protuberance-retaining structure aligned on a portion of the longitudinal axis of the main body. The securing member may include the other of the first and second connecting protuberances or the first and second protuberance-retaining structures, and the other of the third connecting protuberance or the third protuberance-retaining structure. The third protuberance-retaining structure may be configured to slidably receive the third connecting protuberance in a single sliding direction. The first and second protuberance-retaining structures may be configured to snapably retain the first and second connecting protuberances, respectively, so that the buckle housing is secured with respect to the securing member.

Figure 1:
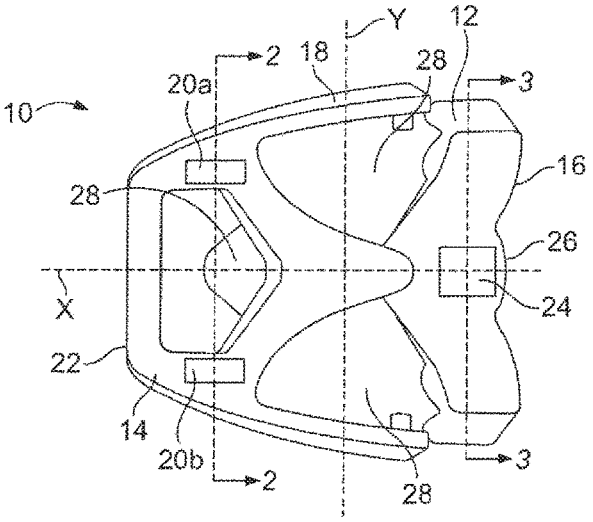
FIG. 1 illustrates a bottom view of a buckle housing, according to an embodiment of the present disclosure.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE DISCLOSURE

FIG. 1 illustrates a bottom view of a buckle housing 10, according to an embodiment of the present disclosure. The buckle housing 10 is configured to be secured to a component, such as a webbing, strap, sheet, ribbon, cord, string, rope, or other such component. The buckle housing 10 my be a male connection member or a female connection member, for example. The buckle housing 10 may be formed of plastic and/or metal. As an example, the buckle housing 10 may be integrally molded and formed as a single piece of injection-molded plastic.

The buckle housing 10 includes a main body 12 including a front end 14 connected to a rear end 16 through an intermediate section 18. Alternatively, the front end 14 may be the rear end, while the rear end 16 may be the front end. The front end 14 may include two lateral connecting protuberances 20*a* and 20*b*, such as pegs, posts, barbs, clasps, latches, snaps, or the like, that are symmetrical about a longitudinal axis X of the main body 12. Each connecting protuberance 20*a* and 20*b* extends downwardly (or upwardly, depending on the orientation) from the main body 12. As shown, the connecting protuberances 20*a* and 20*b* may be positioned proximate to the front end 14. As an example, the connecting protuberances 20*a* and 20*b* may be positioned at a front edge 22 of the front end 14. Optionally, as shown, the connecting protuberances 20*a* and 20*b* may be positioned inboard from the front edge 22. For example, the connecting protuberances 20*a* and 20*b* may be positioned between the front edge 22 and a central lateral axis Y of the main body 12. The connecting protuberances 20*a* and 20*b* may be configured to snapably secure to reciprocal features of a securing member, as described below.

The rear end 16 may include a central connecting protuberance 24, such as a peg, post, barb, clasp, latch, or the like that is positioned along and symmetrical with the longitudinal axis X of the main body 12. The connecting protuberance 24 extends downwardly (or upwardly, depending on the orientation) from the main body 12. As shown, the connecting protuberances 24 may he positioned proximate to the rear end 16. As an example, the connecting protuberance 24 may be positioned at a rear edge 26 of the rear end 16. Optionally, as shown, the connecting protuberance 24 may be positioned inboard from the rear edge 26. For example, the connecting protuberance 24 may be positioned between the rear edge 26 and the central lateral axis Y of the main body 12. The connecting protuberance 24 may be configured to be slidably retained by a reciprocal feature of a securing member, as described below.

The main body 12 may also include one or more cavities 28. The cavities 28 may be sized and shaped to receive and/or retain reciprocal features of a reciprocal buckle housing 10, such as a male connection member, for example. Alternatively, the main body 12 may not include the cavities 28. In short, the main body 12 is sized and shaped to cooperate with a main body of a reciprocal buckle housing.

As shown, the buckle housing 10 may include the two connecting protuberances 20*a* and 20*b*, and the connecting protuberance 24. Alternatively, the buckle housing 10 may include more or less connecting protuberances than those shown. As one example, the connecting protuberance 24 may be bifurcated into two connecting protuberances separated by a space or gap. Also, for example, instead of three connecting protuberances, the buckle housing 10 may include the connecting protuberance 24 proximate to the rear end 16 and a connecting protuberance aligned along the longitudinal axis X proximate to the front end 14. Also, alternatively, instead of the connecting protuberance 24, the buckle housing 10 may include two additional connecting protuberances similar to the connecting protuberances 20*a* and 20*b*, but positioned proximate to the rear end 16. Also, alternatively, the connecting protuberances 20*a* and 20*b* may be configured to be slidably retained by portions of a securing member, while the connecting protuberance 24 is configured to be snapably retained by another portion of the securing member. In short, the buckle housing 10 may include any number of connecting protuberances that are sized, shaped, and positioned to cooperate with reciprocal features located on the securing member, such as a securing plate, that is configured to securely connect the buckle housing 10 to a component.

Figure 2:
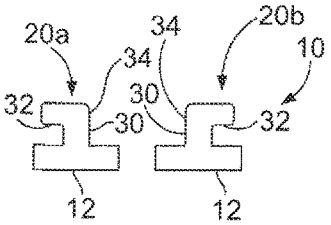
FIG. 2 illustrates a cross-sectional view of connecting protuberances of a buckle housing through line 2-2 of FIG. 1, according to an embodiment of the present disclosure.

FIG. 2 illustrates a cross-sectional view of the connecting protuberances 20*a* and 20*b* of the buckle housing 10 through line 2-2 of FIG. 1, according to an embodiment of the present disclosure. Each connecting protuberance 20*a* and 20*b* may include an extension beam 30 downwardly extending from the main body 12. A perpendicular flange 32 may outwardly extend (outward in relation to a central vertical plane that is aligned with the central longitudinal axis X shown in FIG. 1) from an upper end 34 of the extension beam 30, thereby forming an L-shaped cross-section. Alternatively, the flange 32 may inwardly extend from the upper end 34. Also, alternatively, the flange 32 may inwardly and outwardly extend from the upper end 34. In short, the flange 32 is sized and shaped to be securely retained by a reciprocal feature of the securing member, such as a securing plate, that is configured to securely connect the buckle housing 10 to a component.

Figure 3:
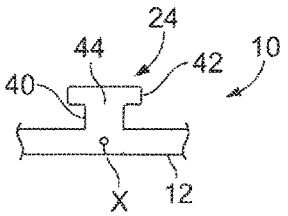
FIG. 3 illustrates a cross-sectional view of a connecting protuberance of a buckle housing, through line 3-3 of FIG. 1, according to an embodiment of the present disclosure.

FIG. 3 illustrates a cross-sectional view of the connecting protuberance 24 of the buckle housing 10, through line 3-3 of FIG. 1, according to an embodiment of the present disclosure. The connecting protuberance 24 may include an extension beam 40 downwardly extending from the main body 12. Perpendicular flanges 42 may outwardly extend (outward in relation to the central longitudinal axis X of the buckle housing) from an opposite sides of an upper end 44 of the extension beam 40 on either side of the longitudinal axis X, thereby forming a T-shaped cross-section. Alternatively, only a single flange may extend to only one side of the longitudinal axis X. The flanges 42 are sized and shaped to be slidably retained by a reciprocal feature of the securing member, such as a securing plate, that is configured to securely connect the buckle housing 10 to a component.

Referring to FIGS. 1-3, the connecting protuberances 20*a*, 20*b*, and 24 may be sized and shaped to be securely retained by reciprocal features of a securing member. For example, the connecting protuberances 20*a*, 20*b*, and 24 may have rectangular, arcuate, irregular-shaped, or the like cross-sections, depending on the size and shape of the reciprocal retaining features of the securing member.

Figure 4:
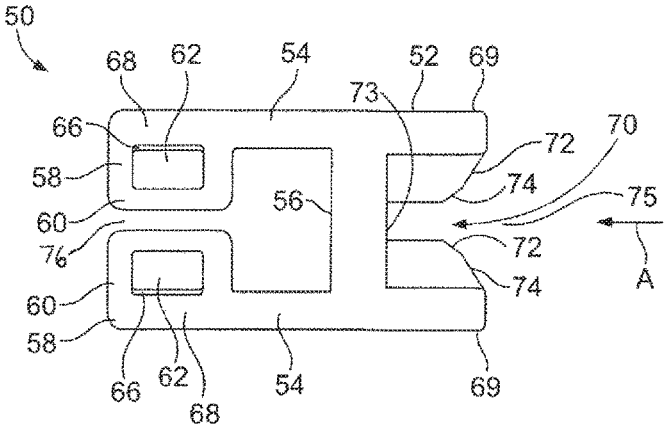
FIG. 4 illustrates a bottom view of a securing member, according to an embodiment of the prevent disclosure.

FIG. 4 illustrates a bottom view of a securing member 50, according to an embodiment of the prevent disclosure. The securing member 50 may be formed from plastic and/or metal. For example, the securing member 50 may be integrally molded and formed as a single piece of injection-molded plastic. The securing member 50 is configured to securely connect the buckle housing 10 (shown in FIGS. 1-3) to a component, such as a piece of webbing, strap, sheet, ribbon, cord, string, rope, or other such component.

The securing member 50 may be a plate, beam, clip, or the like having a main body 52 that includes lateral arms 54 extending outwardly from a central cross beam 56. Each lateral arm 54 includes a protuberance-retaining structure 58, such as a ring, eyelet, or the like, that is configured to receive and retain one of the connecting protuberances 20*a* and 20*b*. For example, each protuberance-retaining structure 58 may include an outer retaining wall 60 defining a central passage 62. A ledge 66 may inwardly extend into the central passage 62 from an outer wall 68. The ledge 66 is sized, shaped, and positioned to securely mate with the flange 32 of one of the connecting protuberances 20*a* and 20*b*. The protuberance-retaining structure 58 may be configured to snapably retain one of the connecting protuberances 20*a* and 20*b*.

For example, referring to FIGS. 1, and 4, the connecting protuberance 20*a* or 20*b* may be inserted through the central passages 62. When the flanges 32 encounters the ledges 66, the protuberance-retaining structures 58 may outwardly deflect as flanges 32 securely mount over the ledges 66, thereby securing the connecting protuberance 20*a* or 20*b* to the protuberance-retaining structures 58.

As the securing member 50 is connected to the buckle housing 10, the lateral arms 54 may deflect open away from each other, thereby increasing the area of the open mouth 76 therebetween. That is, the lateral arms 54 may spread open as the connecting protuberances snapably secure into the protuberance-retaining structures 58. After the securing member 50 is fully secured to the buckle housing 10, and during normal use, the lateral arms 54 may be prevented from further opening motion by the general loading on the component portion (e.g., fabric) that is compressively sandwiched between the securing member 50 and the buckle housing 10. The component portion (e.g., the fabric) may force the flexible portions (e.g., the lateral arms 54) of the securing member 50 to be securely fixed in place with respect to the buckle housing 10. Accordingly, the assembly including the buckle housing 10 and the securing member 50 provides increased retaining strength.

Lateral arms 69 extend outwardly from the central cross beam 56 in an opposite direction from the lateral arms 54. The lateral arms 69 define an open-ended central passage 70 having ledges 72 inwardly extending from the lateral arms 68, thereby providing a protuberance-retaining structure 73 that is configured to slidably receive the connecting protuberance 24 (shown in FIGS. 1 and 3). Distal (in relation to the cross beam 56) internal edges 74 at an open mouth 75 between the lateral arms 68 may be beveled to form lead-in features configured to guide the connecting protuberance 24 toward the cross beam 56.

In order to connect the buckle housing 10 to the securing member 50, the connecting protuberance 24 may be aligned with the central passage 70 so that the flanges 42 slide over the ledges 72 as the securing member 50 is slid toward the buckle housing 10, or vice versa. When sliding movement of the connecting protuberance 24 in the direction of arrow A is blocked by the cross beam 56, connecting protuberances :20*a* and 20*b* are aligned with the respective protuberance-retaining structures 58, and may then be snapably secured thereto, for example, as described above.

Alternatively, the protuberance-retaining structures 58 may be configured to slidably receive the respective connecting protuberances 20*a* and 20*b*, while the protuberance-retaining structure 73 may be configured to snapably receive and retain the connecting protuberance 24. For example, each protuberance-retaining structure 58 may alternatively include an open-receiving end, while the protuberance-retaining structure 73 may include an outer wall defining an eyelet. Also, alternatively, all of the protuberance-retaining structures 58 and 73 may be sized, shaped, and configured to snapably retain the connecting protuberances 20*a*, 20*b*, and 24.

Figure 5:
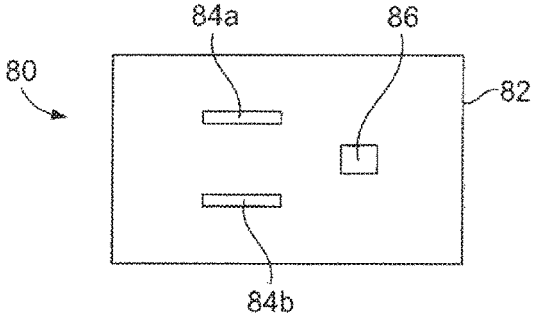
FIG. 5 illustrates a bottom of a component, according to an embodiment of the present disclosure.

FIG. 5 illustrates a bottom view of a component 80, according to an embodiment of the present disclosure. The component 80 may be a piece of material to which a buckle mounting assembly, including the buckle housing 10 and the securing member 50, is configured to be secured. The component 80 may be a piece of webbing, strap, sheet, ribbon, cord, string, rope, or other such component. The component 80 may be formed of rubber, cloth, fabric, leather, cardboard, wood, plastic, metal, or the like.

The component 80 may include a planar sheet 82 having openings 84*a*, 84*b*, and 86 formed therethrough. The openings 84*a* and 84*b* are sized and shaped to receive the connecting protuberance 20*a* and 20*b* (shown in FIGS. 1 and 2), while the opening 86 is sized and shaped to receive the connecting protuberance 24 (shown in FIGS. 1 and 3). For example, the extension beams 30 are configured to pass through the openings 84*a* and 84*b*, respectively, while the extension beam 40 is configured to pass through the opening 86. The pattern of openings 84*a*, 84*b*, and 86 conforms to the pattern of connecting protuberances of the buckle housing 10, and the protuberance-retaining structures of the securing member 50.

Figure 6:
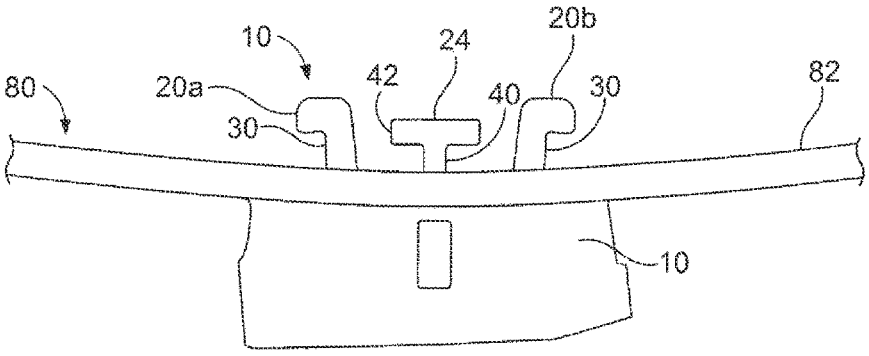
FIG. 6 illustrates an end view of a buckle housing positioned with respect to a component, according to an embodiment of the present disclosure.

FIG. 6 illustrates an end view of the buckle housing 10 positioned with respect to the component 80, according to an embodiment of the present disclosure. Referring to FIGS. 1-3, 5 and 6, the extension beams 30 of the connecting protuberances 20*a* and 20*b* are positioned through the openings 84*a* and 84*b*, respectively, while the extension beam 40 of the connecting protuberance 24 is positioned through the opening 86. In order to securely connect the buckle housing 10 to the component 80, the securing member 50 (shown in FIG. 4) is mated to the buckle housing 10, as described below.

Figure 7:
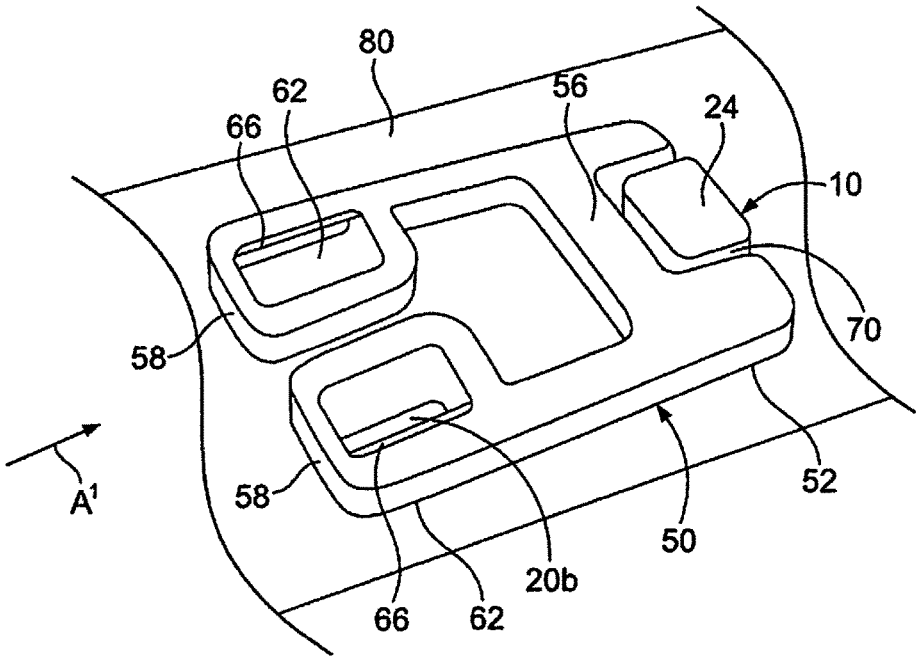
FIG. 7 illustrates a bottom view of a securing member connecting to a buckle housing and a component in an initial position, according to an embodiment of the present disclosure.

FIG. 7 illustrates a bottom view of the securing member 50 connecting to the buckle housing 10 and the component 80 in an initial position, according to an embodiment of the present disclosure. Referring to FIGS. 4 and 7, the securing member 50 is slid toward the buckle housing 10 (or vice versa) in the direction of arrow A' so that the central passage 70 slidably receives the connecting protuberance 24. During this initial sliding motion, the flanges 42 (shown in FIGS. 3 and 6) slide on the ledges 72. As the securing member 50 is urged into the connecting protuberance 24 in the direction of arrow A', the extension member 40 of the connecting protuberance 24 abuts into the cross beam 56, thereby halting further movement in the direction of arrow A'. At this position, the connecting protuberances 20*a* and 20*b* of the buckle housing 10 are aligned with the central passages 62 of the securing member 50. In order to complete the connection of the buckle housing 10 to the component 80, the connecting protuberances 20*a* and 20*b* are snapably secured into the central passages 62, as described above. As the connecting protuberances 20*a* and 20*b* are urged into the central passages 62, the connecting protuberances 20*a* and 20*b* inwardly deflect or otherwise deform until the flanges 32 flex back to a secure position on the ledges 66.

Figure 8:
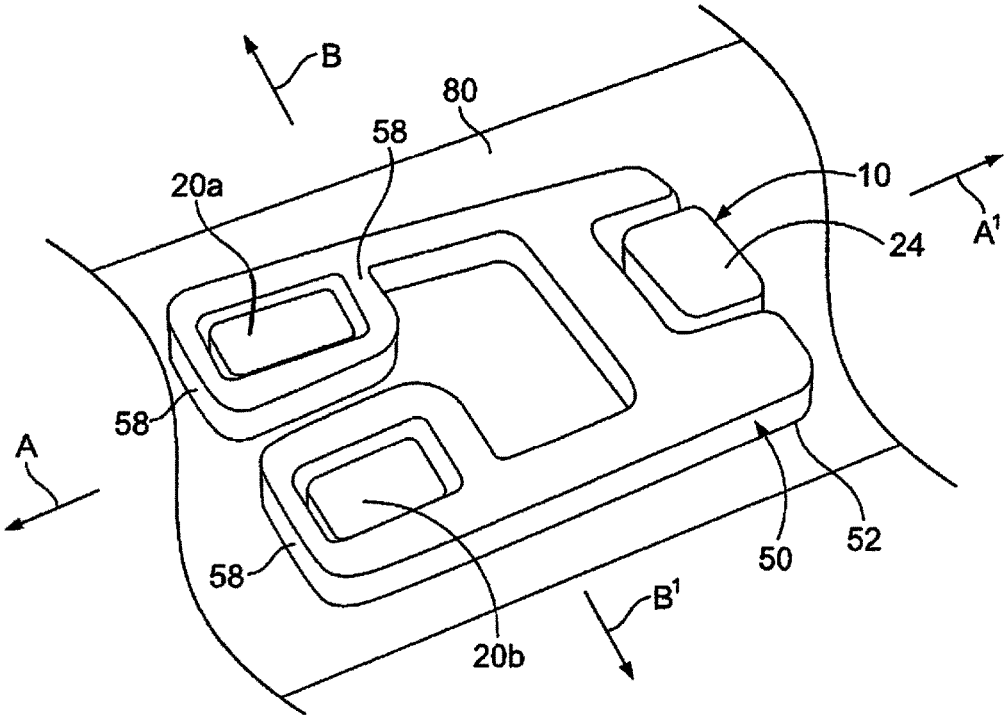
FIG. 8 illustrates a bottom view of a securing member securely connecting a buckle housing to a component, according to an embodiment of the present disclosure.

FIG. 8 illustrates a bottom view of the securing member 50 securely connecting the buckle housing 10 to the component 80, according to an embodiment of the present disclosure. As shown, the connecting protuberances 20*a* and 20*b* are securely retained by the protuberance-retaining structures 58. As noted, the connecting protuberances 20*a* and 20*b* may be snapably secured to the protuberance-retaining structure 58. The protuberance-retaining structures 58 trap the connecting protuberances 20*a* and 20*b* within the central passage 62, thereby preventing the buckle housing 10 from shifting in the directions of arrows A, A', B, and B'. As such, the protuberance retaining structures 58 snapably retain the connecting protuberances 20 and 20*b* to securely fix the buckle housing 10 with respect to the securing member 50.

The component 80, such as fabric, may assist in ensuring a secure engagement between the connecting protuberances 20*a* and 20*b* and the protuberance-retaining structures 58. At least a portion of an opposing load applied into the component may tend to squeeze the protuberance retaining structures 58 toward one another, thereby providing a more secure connecting with the connecting protuberances 20*a* and 20*b*. Securing force(s) between the protuberance-retaining structures 58 and the connecting protuberances 20*a* and 20*b* may be increased when an extraneous load exerts a force into the component, onto which the buckle housing 10 and the securing member 50 are secured.

Referring to FIGS. 5-8, as described above, in order to secure the buckle housing 10 to the component 80, the connecting protuberances 20*a*, 20*b*, and 24 are positioned through the openings 84*a*, 84*b*, and 86, respectively of the component 80. The securing member 50 is then slid in a single sliding direction over the component 80 on an opposite side from the main body 12 of the buckle housing 10 so that the central passage 70 slidably receives a portion of the connecting protuberance 24 until the connecting protuberances 20*a* and 20*b* align with the central passages 62 of the protuberance-retaining structures 58. Once aligned, the connecting protuberances 20*a* and 20*b* are snapably secured to the protuberance-retaining structures 58, thereby compressively sandwiching a portion of the component 80 between the main body 12 of the buckle housing 10 and the main body 52 of the securing member 50.

Figure 9:
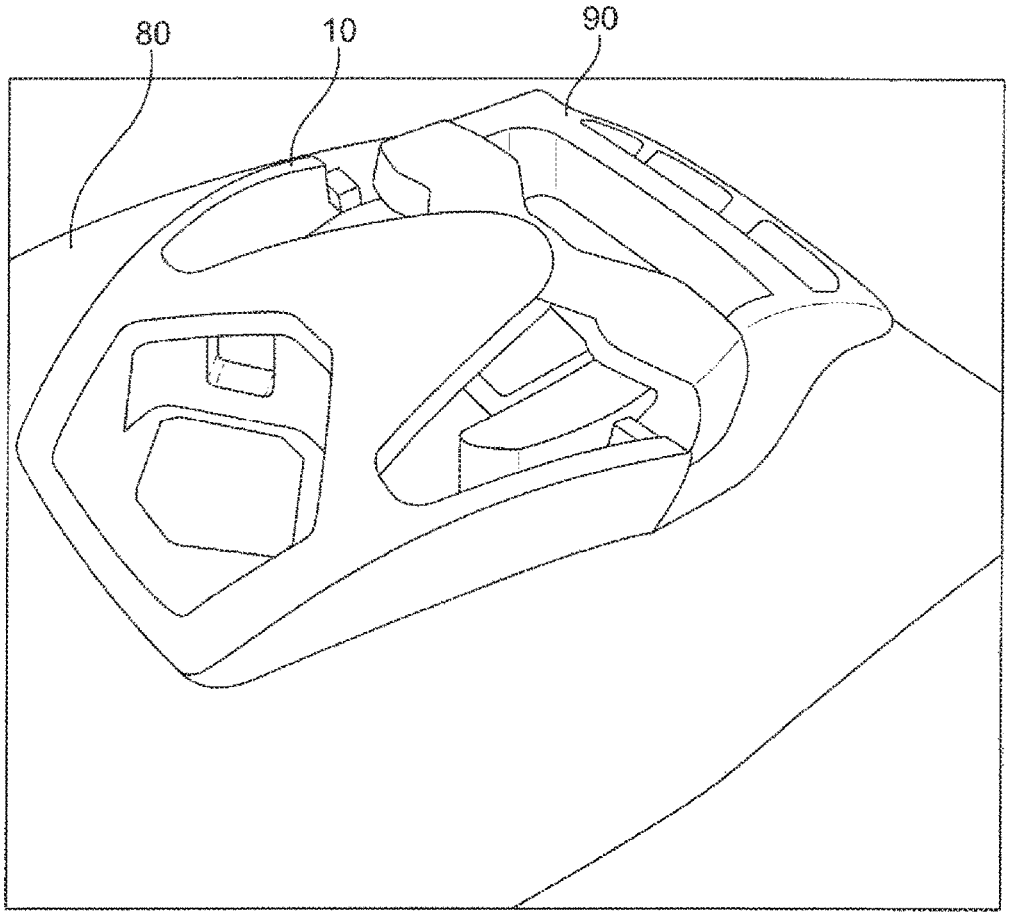
FIG. 9 illustrates a top view of a buckle housing secured to a component, according to an embodiment of the present disclosure.

FIG. 9 illustrates a top view of the buckle housing 10 secured to the component 80, according to an embodiment of the present disclosure. As shown, the buckle housing 10 may be a female connection member that is configured to securely connect to a male connection member 90. Optionally, the male connection member 90 may secure to the component 80 or another component (or another end of the component 80) similar to as described above. For example, the buckle housing 10 may be a female connection member, a male connection member, or both. It is to be understood that the male connection member 90 and the female connection member in the form of the buckle housing 90 may be various sizes, shapes, configurations, and the like. The embodiments shown in FIG. 9 are merely examples, but various other styles, shapes, and sizes may be used.

Referring to FIGS. 1-9, while the buckle housing 10 is shown and described as having the connecting protuberances 20*a*, 20*b*, and 24, and the securing member 50 is shown and described as having the protuberance-retaining structures 58 and 73, the buckle housing 10 may alternatively include protuberance-retaining structures, while the securing member 50 includes the connecting protuberances. Also, alternatively, as noted above, more or less connecting protuberances and reciprocal protuberance-retaining structures may be used. Moreover, the protuberance-retaining structures and the connecting protuberances may be positioned at various other positions than shown.

Figure 10:
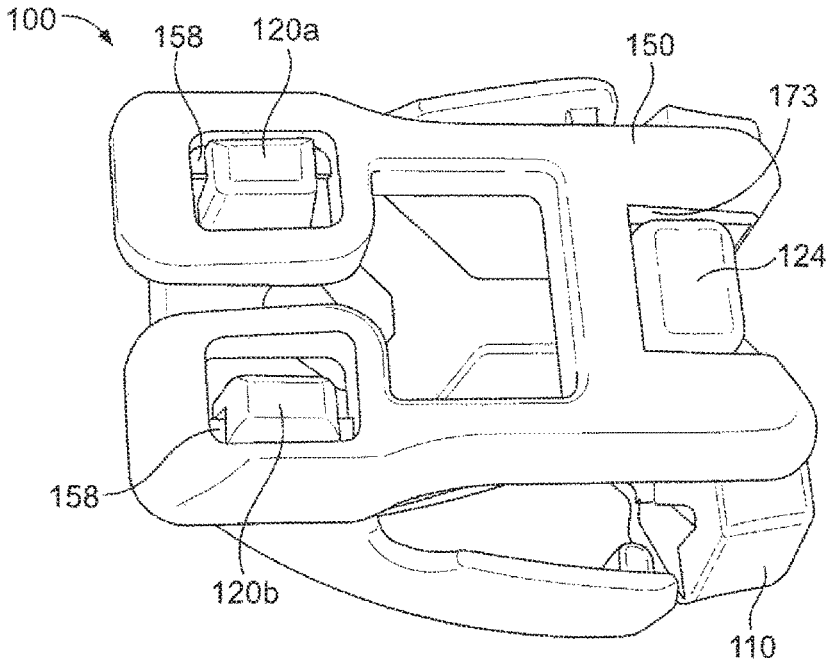
FIG. 10 illustrates a bottom perspective view of a buckle assembly, according to an embodiment of the present disclosure.
Figure 11:
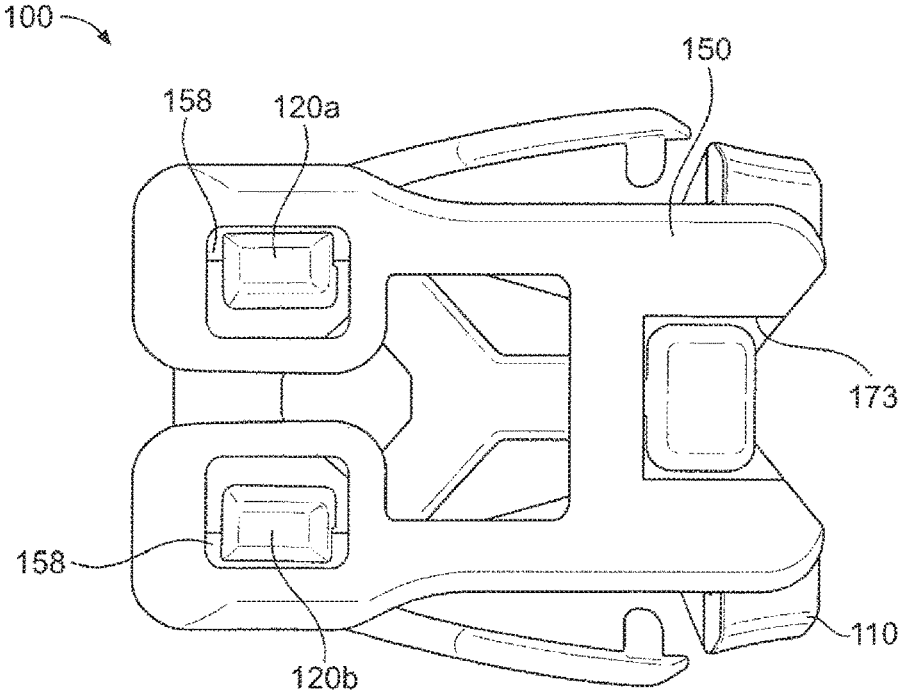
FIG. 11 illustrates a bottom plan view of a buckle assembly, according to an embodiment of the present disclosure.

FIG. 10 illustrates a bottom perspective view of a buckle assembly 100, according to an embodiment of the present disclosure. FIG. 11 illustrates a bottom view of the buckle assembly 100. Referring to FIGS. 10 and 11, the buckle assembly 100 is similar to the buckle assembly 10, and includes a buckle housing 110 that removably connects to a securing member 150. The buckle housing 110 may include connecting protuberances 120*a*, 120*b*, and 124 that are retained by protuberance-retaining structures 158 and 173 of the securing member 150. Alternatively, the buckle housing 110 may include the protuberance-retaining structures, while the securing member 150 includes the connecting protuberances.

It is to be understood that embodiments of the present disclosure may be used with various types of buckle assemblies. For example, embodiments of the present disclosure may be used in conjunction with any of the assemblies shown and described in U.S. Pat. No. 6,668,428, entitled "Fasteners incorporating a Whistle," U.S. Pat. No. 7,331,088, entitled "Buckle Assembly," U.S. Pat. No. 7,296,327, entitled "Buckle Assembly," U.S. Pat. No. 7,302,742, entitled "Side Release Buckle Assembly," PCT Publication WO2012/162615, entitled "Buckle Assembly," United States Patent Application Publication No. 2007/0089280, entitled "Side Release Buckle Assembly," and United States Patent Application Publication No. 2008/0222860, entitled "Buckle Assembly," all of which are hereby incorporated by reference in their entireties.

Embodiments of the present disclosure provide a buckle assembly that is configured to securely mount a buckle housing to a component. The buckle assembly may include the buckle housing and a securing member that securely connects the buckle housing to the component. Unlike known assemblies, embodiments of the present disclosure secure the buckle housing to the component through a sliding motion in a single sliding direction, and then a separate and distinct securing motion, such as in a snapping direction. Embodiments of the present disclosure may not securely connect the buckle housing to the component through a first sliding motion, and a second sliding motion that differs from the first sliding motion. That is, embodiments of the present disclosure may not secure the buckle housing to the securing member through separate and distinct sliding directions.

The buckle housing may be quickly and easily connected to the component. For example, once the securing member is no longer able to be slid into or onto the buckle housing (for example, the securing member is slid onto the connecting protuberance 24), an individual may then simply snapably secure the securing member to the buckle housing. An individual may securely connect the buckle housing to the component by hand, without the need for special tools. Moreover, the buckle housing may be disconnected from the securing member, in order to replace the buckle housing if defective, for example. For example, the connecting protuberances 20*a* and 20*b* may be squeezed together to disengage from secure connection with the protuberance-retaining structures 58, and then the securing member 50 may simply be slid off of the buckle housing 10.

Additionally, embodiments of the present disclosure provide a securing member, such as a securing plate, that may include a smooth outer profile having rounded edges that are not (or otherwise less) susceptible to catching on the component.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

To the extent used in the appended claims, the terms "including" and "in which" are used as the plain-English equivalents of the respective terms "comprising" and "wherein." Moreover, to the extent used in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

Various features of the disclosure are set forth in the following claims.

The invention claimed is:

1. A buckle assembly configured to securely attach to a component, the buckle assembly comprising:

a buckle housing that is configured to removably couple to a reciprocal buckle housing, the buckle housing including a first connecting protuberance and a second connecting protuberance; and a securing member including a first protuberance-retaining structure and a second protuberance-retaining structure, wherein the first protuberance-retaining structure is configured to slidably receive the first connecting protuberance in a sliding direction, wherein the second protuberance-retaining structure comprises lateral arms and an open mouth separating the lateral arms, wherein the lateral arms are configured to deflect away from one another as the securing member is connected to the buckle housing, thereby increasing the area of the open mouth between the lateral arms, wherein ledges extend inwardly from interior surfaces of the lateral arms, and wherein the second protuberance-retaining structure is configured to securely retain the second connecting protuberance so that the buckle housing is secured with respect to the securing member.

2. The buckle assembly of claim 1, wherein the second protuberance-retaining structure is configured to snapably retain the second connecting protuberance.

3. The buckle assembly of claim 1, wherein at least a portion of the component is configured to be compressively sandwiched between the buckle housing and the securing member.

4. The buckle assembly of claim 1, wherein the first connecting protuberance comprises an outwardly-directed flange connected to an extension beam.

5. The buckle assembly of claim 1, wherein the second connecting protuberance comprises outwardly-directed flanges extending from opposite sides of an extension beam.

6. The buckle assembly of claim 1, wherein the first protuberance-retaining structure comprises an outer retaining wall defining a central passage, wherein a ledge inwardly extends into the central passage from an interior surface of the outer retaining wall.

7. The buckle assembly of claim 1, wherein the buckle housing comprises a female connection member or a male connection member.

8. The buckle assembly of claim 1, wherein at least one securing force between the second protuberance-retaining structure and the second connecting protuberance is increased when one or more forces is exerted into the component onto which the buckle housing and the securing member are secured.

9. A buckle system comprising:

a component defining first and second openings;

a buckle housing that is configured to removably couple to a reciprocal buckle housing, the buckle housing including a first connecting protuberance and a second connecting protuberance; and a securing member including a first protuberance-retaining structure and a second protuberance-retaining structure, wherein the first connecting protuberance extends through the first opening and the second connecting protuberance extends through the second opening, wherein the first protuberance-retaining structure is configured to slidably receive the first connecting protuberance in a sliding direction, wherein the second protuberance-retaining structure comprises lateral arms and an open mouth separating the lateral arms, wherein the lateral arms are configured to deflect away from one another as the securing member is connected to the buckle housing, thereby increasing the area of the open mouth between the lateral arms, wherein ledges extend inwardly from interior surfaces of the lateral arms, and wherein the second protuberance-retaining structure is configured to securely retain the second connecting protuberance so that the buckle housing is secured with respect to the securing member.

10. The buckle system of claim 9, wherein the second protuberance-retaining structure is configured to snapably retain the second connecting protuberance.

11. The buckle system of claim 9, wherein at least a portion of the component is configured to be compressively sandwiched between the buckle housing and the securing member.

12. The buckle system of claim 9, wherein the first connecting protuberance comprises an outwardly-directed flange connected to an extension beam.

13. The buckle system of claim 9, wherein the second connecting protuberance comprises outwardly-directed flanges extending from opposite sides of an extension beam.

14. The buckle system of claim 9, wherein the first protuberance-retaining structure comprises an outer retaining wall defining a central passage, wherein a ledge inwardly extends into the central passage from an interior surface of the outer retaining wall.

15. The buckle system of claim 9, wherein the buckle housing comprises a female connection member or a male connection member.

16. The buckle system of claim 9, wherein one or more forces exerted into the component increase a securing force between the second protuberance-retaining structure and the second connecting protuberance.

17. A buckle assembly configured to securely attach to a component, the buckle assembly comprising:

a buckle housing that is configured to removably couple to a reciprocal buckle housing, the buckle housing including first and second connecting protuberances symmetrically positioned about a longitudinal axis of a main body, and a third connecting protuberance aligned on a portion of the longitudinal axis of the main body; and a securing member including first, second, and third protuberance-retaining structures, wherein the third protuberance-retaining structure is configured to slidably receive the third connecting protuberance in a single sliding direction, wherein the first and second protuberance-retaining structures comprise first and second lateral arms separated by an open mouth, wherein the first and second lateral arms are configured to deflect away from one another as the securing member is connected to the buckle housing, thereby increasing the area of the open mouth between the first and second lateral arms, are configured to snapably retain the first and second connecting protuberances, respectively, so that the buckle housing is secured with respect to the securing member, wherein at least a portion of the component is configured to be compressively sandwiched between the buckle housing and the securing member.

18. The buckle assembly of claim 17, wherein the first and second connecting protuberances comprise an first and second outwardly-directed flanges connected to first and second extension beams, respectively, and wherein the third connecting protuberance comprises third and fourth outwardly-directed flanges extending from opposite sides of a third extension beam.

19. The buckle assembly of claim 18, wherein each of the first and second protuberance-retaining structures comprise an outer retaining wall defining a central passage, wherein a ledge inwardly extends into the central passage from an interior surface of the outer retaining wall, and wherein the third protuberance-retaining structure comprises lateral arms defining an open mouth.

20. The buckle assembly of claim 17, wherein the buckle housing comprises a female connection member or a male connection member.

* * * * *